United States Patent [19]

Appleton

[11] 4,260,863

[45] Apr. 7, 1981

[54] VENTED PLASTIC ENCLOSURE FOR ARCING DEVICES

[76] Inventor: Arthur I. Appleton, 22 Indian Creek Dr., Indian Creek Village, Fla. 33154

[21] Appl. No.: 958,012

[22] Filed: Nov. 6, 1978

Related U.S. Application Data

[63] Continuation of Ser. No. 804,501, Jun. 8, 1977, abandoned, which is a continuation-in-part of Ser. No. 613,021, Sep. 12, 1975, abandoned.

[51] Int. Cl.[3] ..... H01H 33/08

[52] U.S. Cl. ..... 200/144 R; 200/149 A

[58] Field of Search ..... 200/144 R, 146 R, 145, 200/149 A; 240/11.2 E; 174/51

[56] References Cited

U.S. PATENT DOCUMENTS

| | | | |
|---|---|---|---|
| 2,050,346 | 8/1936 | Lingal | 200/145 |
| 3,675,007 | 7/1972 | Appleton et al. | 240/11.2 E |
| 3,739,122 | 6/1973 | Pierzchala | 200/146 R |
| 3,927,249 | 12/1975 | Pearse | 174/51 |

FOREIGN PATENT DOCUMENTS

| | | | |
|---|---|---|---|
| 1255477 | 1/1960 | France | 200/144 R |

*Primary Examiner*—Robert S. Macon

*Attorney, Agent, or Firm*—Darbo & Vandenburgh

[57] ABSTRACT

The cover of a housing has one or more projections which extend into a slot or respective slots in the main body of the housing. Each projection is spaced from the walls defining the slot so as to form a passageway from the interior of the housing to the outside. This passageway is sufficiently long and narrow as to cool burning gases initiated within the housing by an arc, the cooling being sufficient to extinguish the flame before it reaches the exterior of the housing. The passageways completely encircle the interior compartment of the housing so as to provide sufficient passageway area to relieve the internal pressure caused by an explosion within that compartment sufficiently that plastic can be used for the material of the housing.

8 Claims, 13 Drawing Figures

Fig. 1.
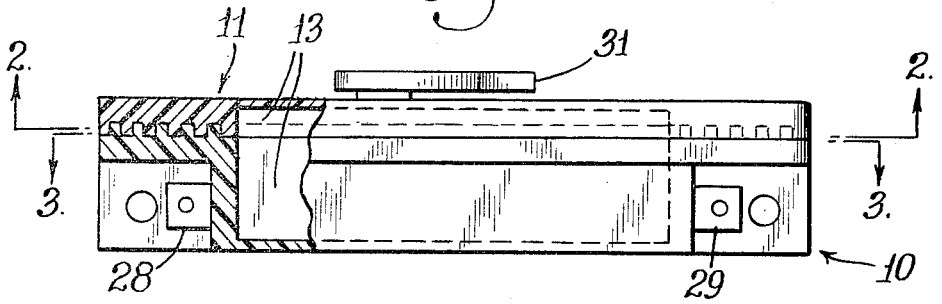
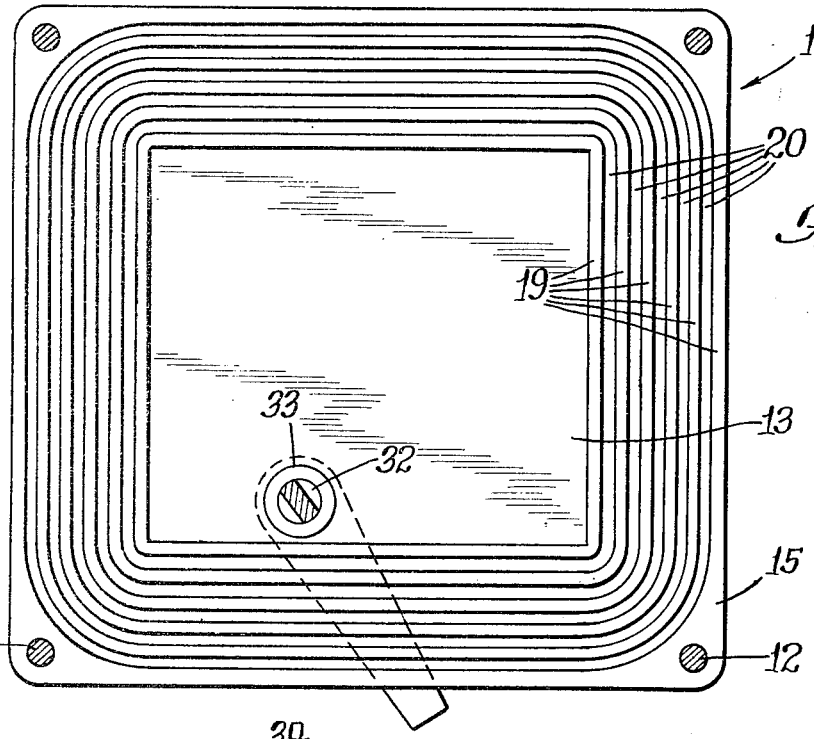
Fig. 2.
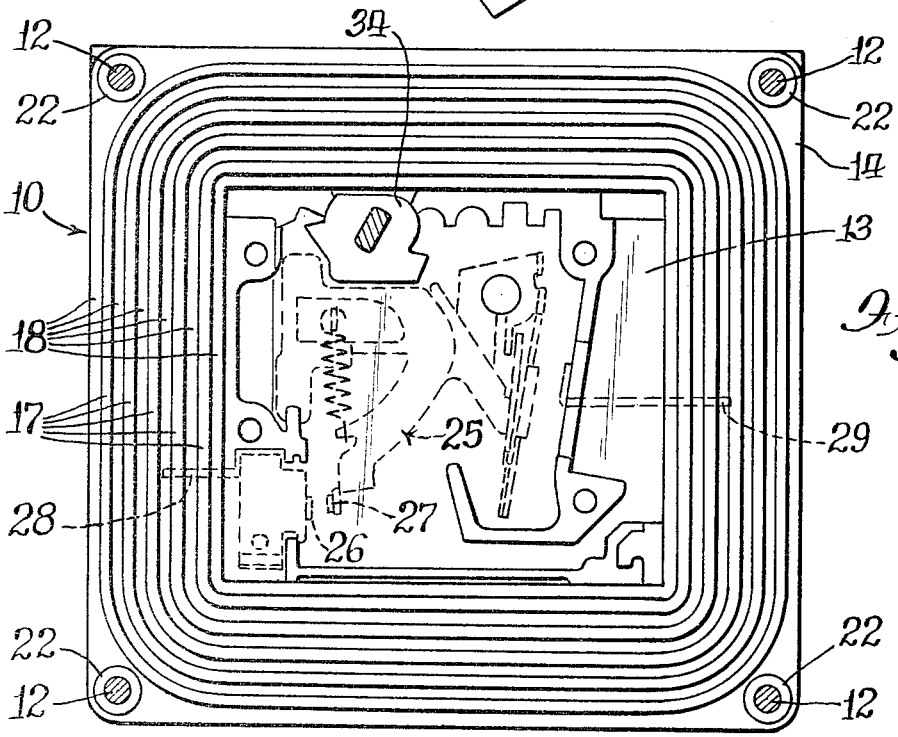
Fig. 3.

VENTED PLASTIC ENCLOSURE FOR ARCING DEVICES

RELATED APPLICATION

This application is a continuation of pending application Ser. No. 804,501, filed June 8, 1977, which was a continuation-in-part of my prior application Ser. No. 613,021, filed Sept. 12, 1975, both now abandoned.

BACKGROUND AND SUMMARY OF THE INVENTION

Where electrical devices are employed in explosive atmospheres precautions must be taken to avoid igniting those atmospheres by reason of an arc produced by an electrical component such as a switch, a circuit breaker, etc. A conventional procedure is to mount such electrical devices within an enclosure sufficiently rigid to withstand the force of an explosion occurring within the container and thereby preventing the flame occurring within the enclosure from reaching the exterior thereof. Such housings may not be completely fluid tight but may have small passageways which serve as vents permitting the escape of gases while being sufficiently small to prevent the escape of flame. Since the passageways are small there can be a substantial pressure build-up in the housing. This necessitates that the housing structure be quite rigid. Such housings often comprise a metal casting. These are quite expensive to manufacture.

The present invention contemplates the use of a plastic housing which has the advantage of being substantially less expensive than a metal casting. Furthermore, the plastic is an electrical insulator so that the electrical components within the housing can be mounted directly on the interior portions of the housing, without the necessity of extra parts to serve to insulate the electrical components from the housing walls, as in the case of a metal housing. To compensate for the difference in strength between metal walls and plastic walls for the housing, a relatively large venting passageway is provided between the interior of the housing and the exterior, the passageway being sufficiently large in area to avoid substantial pressure build-up within the housing. At the same time, the passageway is sufficiently long and narrow as to serve to prevent any flame from within the housing propagating to the exterior of the housing through the passageway. That is, the plastic walls defining the sides of the passageway will cool the burning gases to the point where they are extinguished before reaching the exterior of the housing.

Further objects and advantages will become apparent from the following description taken in conjunction with the drawings.

DESCRIPTION OF THE DRAWINGS

FIG. 1 is a side elevation of a first embodiment of the invention, with portions broken away;

FIG. 2 is an interior view of the cover as seen at line 2—2 of FIG. 1;

FIG. 3 is a face view of the housing body as seen at line 3—3 of FIG. 1;

DESCRIPTION OF SPECIFIC EMBODIMENTS

Figure 4:
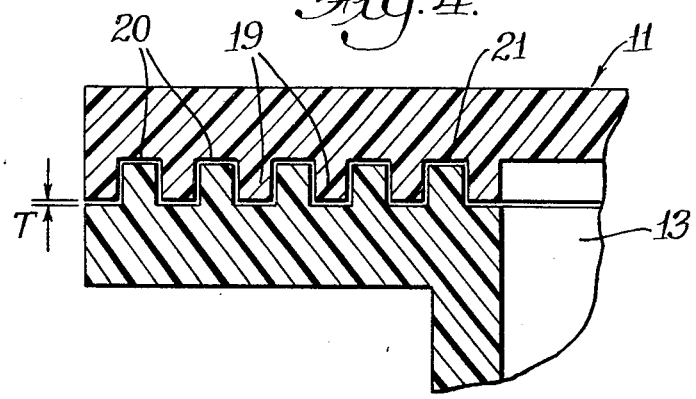
FIG. 4 is an enlarged view similar to the left side of FIG. 1.

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

The embodiment of FIGS. 1–4 includes a main body, generally 10, and a cover, generally 11. These are both formed of plastic, as for example a glass filled polyester resin. Normally the body 10 will be fixedly mounted. The cover is secured to the body as by means of screws 12 which extend through the cover and are threaded into the body. The cover and body define a chamber or space 13 which receives an arcing-prone electrical component, such as an electrical switch, a circuit breaker, or the like. The body has a face 14 which is in juxtaposition to a face 15 of the cover. These faces surround space 13.

Face 14 has a plurality of ridges 17 which define a plurality of recesses 18. The cover has a plurality of ridges 19 positioned to be received in recesses 18 of the body and a plurality of recesses 20 to receive body ridges 17. As best seen in FIG. 4, the plastic walls that define the ridges and recesses are spaced from each other to the end that a passageway 21 extends from the interior space 13 of the housing to the exterior thereof. It will be apparent from FIGS. 2 and 3 that this passageway completely surrounds the space 13. Thus while it is relatively small as seen in cross-section (FIG. 4), its total area is relatively large because of completely surrounding the housing space at the mating faces. To maintain the thickness of the passageway, the dimension T in FIG. 4, the body 10 has bosses 22 (or loose spacers) extending outwardly from face 14 a distance corresponding to the desired thickness T. The exterior ridge 19 of the cover abuts boss 22 to supply the desired passageway thickness. In the disclosed embodiment this thickness is about 0.254 millimeters, but 0.508 millimeters will provide better venting and will be adequately narrow to provide the required cooling effect. The axial length of the passageway, that is its length along its axis as viewed in FIG. 4, should be at least 2.54 centimeters. This thickness and length will be sufficient so that combustion occurring within space 13 will not propagate to the exterior of the housing. The walls defining passageway 21 will cool the flame sufficiently so that it will be extinguished before it reaches the exterior of the housing.

Within space 13 is an arc-prone electrical device such as a circuit breaker, generally 25. The details of such structure are well known and will not be described.

Suffice it to say, it includes a pair of electrical contacts 26 and 27. Contact 26 is connected to an exterior terminal 28, while contact 27 is connected to a terminal 29. When contacts 26 and 27 separate during the course of normal operation, an electrical arc will result, which arc will ignite an explosive atmosphere existing in space 13. These contacts could, of course, be the contacts of a switch, etc. The terminals 28 and 29 may be molded into the plastic walls or inserted through suitable openings which are then sealed about the terminals.

For the purpose of resetting the circuit breaker, there is a handle 31 on the exterior of the cover. This handle is attached to the exterior end of a shaft 32. The shaft is rotatably mounted in a bearing 33 in the cover. At the interior end of the shaft is a cam 34 which, when the shaft is rotated, moves to contact the circuit breaker 25 and reset it to the closed position. If the arc-prone electrical device were a switch, for example, this shaft could be employed to move the movable switch part.

It should be noted that the circuit breaker 25 includes a plurality of metal components which are mounted directly on the body 10. That is, there is no need for separate insulated mountings, etc., to separate the metal components of the circuit breaker from the body as is the case when the housing is formed of metal. This results in a cost saving. The plastic of the housing of the described embodiment serves as an insulator, not only to electrically separate components of the circuit breaker, but to prevent someone who might contact the exterior of the housing from receiving an electrical charge.

In this embodiment the ridges 17 have a height (as viewed in FIG. 1) of 2.362 mm and a width of 1.854 mm. The recesses 18 have a depth of 2.362 mm and a width of 2.362 mm. The ridges 19 have a height (as viewed in FIG. 1) of 2.362 mm and the interior of the ridges have a width of 1.854 mm, while the two exterior ridges have a width of 2.108 mm. The recesses 20 have a height of 2.362 mm and a width of 2.362 mm.

Figure 5:
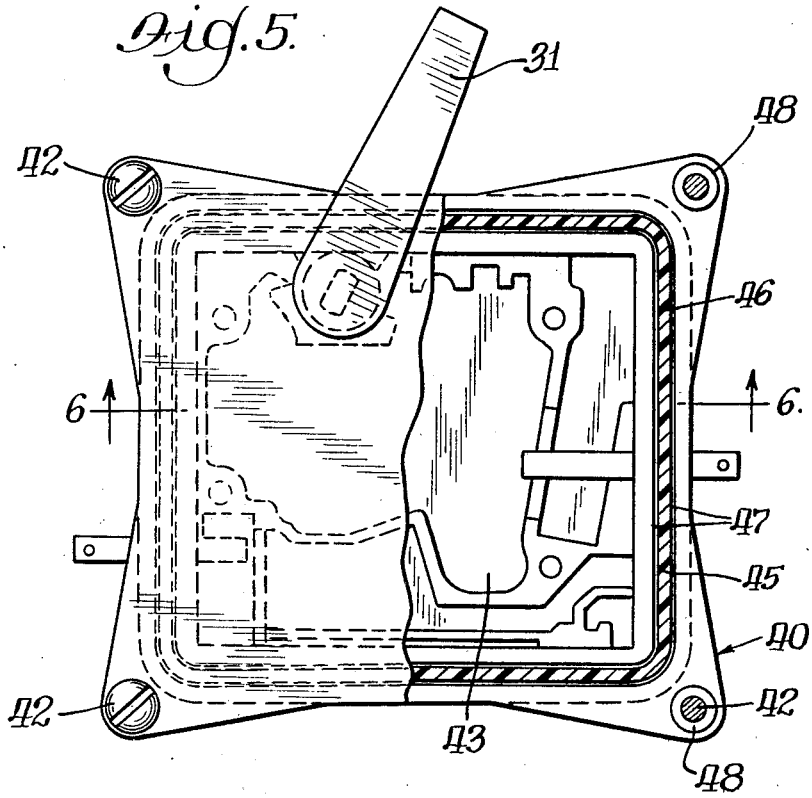
FIG. 5 is a plan view, partially broken away, of a second embodiment of the invention.
Figure 6:
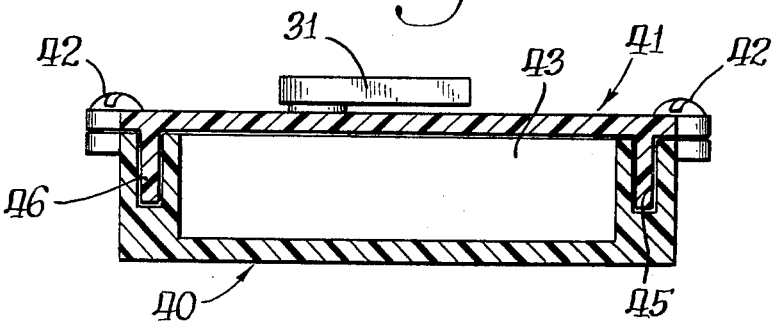
FIG. 6 is a side view of the embodiment of FIG. 5.
Figure 9:
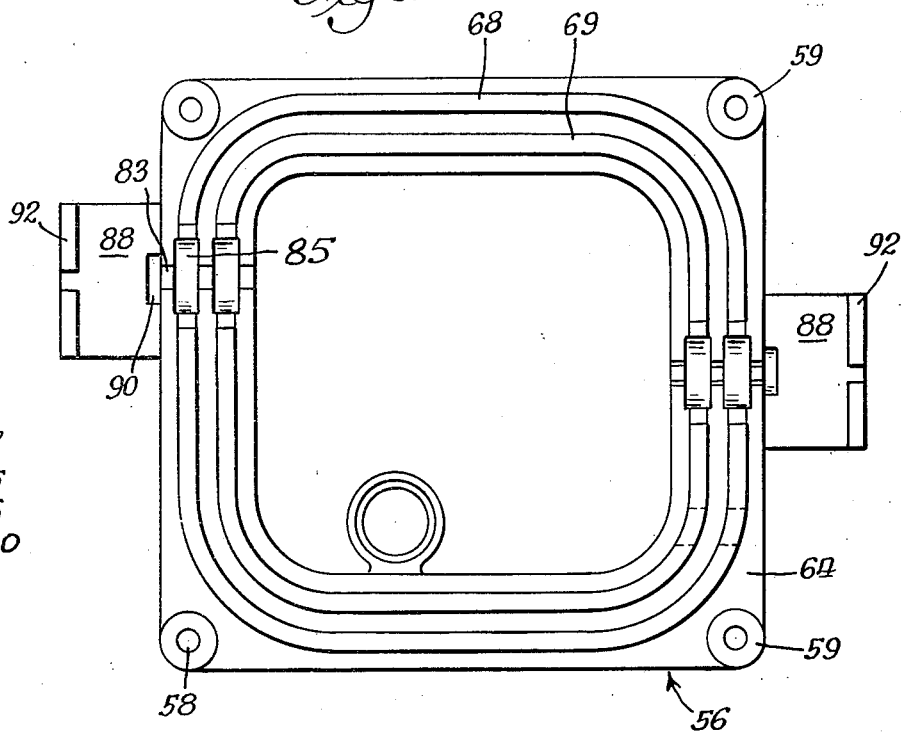
FIG. 9 is a face view of the cover of the embodiment of FIG. 7; p

In the embodiment of FIGS. 5 and 6 there is a body, generally 40, and a cover, generally 41. These are held together by screws 42 and define an interior space 43. The face of the body that is in juxtaposition to the cover defines a single recess 45 which completely surrounds the space 43. The corresponding face of the cover has a single ridge 46 which extends into the recess 45. The recess 45 (as viewed in FIG. 6) is 1.27 cm in depth. Thus, the total axial length of the passageway 47 existing between the space 43 and the exterior of the housing will be in excess of 2.54 cm. The height of the ridge 46 (as viewed in FIG. 6) is likewise 1.27 cm. Spacers 48 are employed between the cover and the body to provide the desired thickness of the passageway at the bottom of the ridge and at the juxtaposed faces between the cover and the body. The embodiment of FIGS. 5 and 6 is for housing a circuit breaker 25, as previously described.

Figure 7:
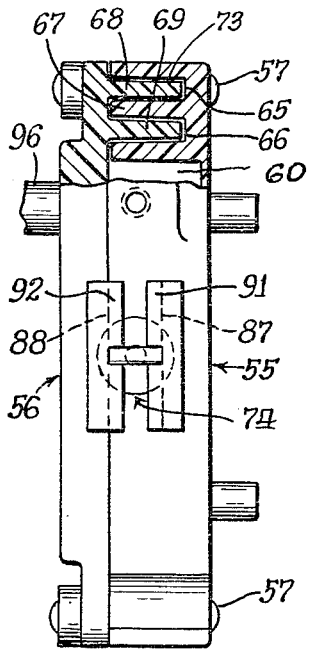
FIG. 7 is a side view, with portions broken away, of another embodiment of the invention.
Figure 8:
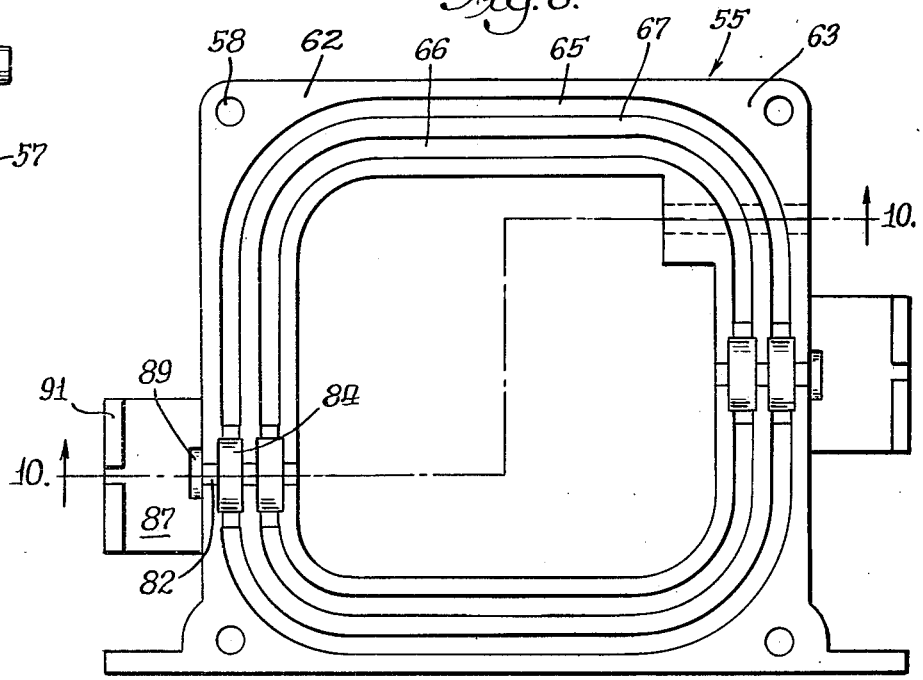
FIG. 8 is a face view of the housing body of the embodiment of FIG. 7.

In the embodiment of FIGS. 7–13 there is a body, generally 55, and a cover, generally 56, which form the housing. These are held in the assembled condition (to form the housing) by rivets 57 which pass through openings 58 in the four corners of the body and cover. On the cover there are bosses 59 through which the openings 58 pass. These bosses act as spacers and contact the face of body 55 to ensure the required thickness of the exhaust passageway. When the cover is in place on the body, as illustrated in FIG. 7, the two define a space 60 to receive a circuit breaker.

The body has a comparatively high rim 62 encircling space 60. This rim has an outer face 63 which, when the cover is in place, is in juxtaposition to face 64 of the cover. Within rim 62 are a pair of recesses 65 and 66 which define a ridge 67 therebetween. The cover has a mating pair of ridges 68 and 69 which define a recess 70 therebetween.

When the cover is in place on the body the ridges 68 and 69 extend into recesses 65 and 66, respectively, while ridge 67 of the body extends into recess 70 of the cover. In each instance the ridge is spaced from the walls defining the recess so that when assembled there is a passageway 73 therebetween. As seen at the top of FIG. 7, this passageway extends from the space 60 within the assembled housing to the exterior of the housing. In this embodiment the passageway has a length of about 2.5 inches (6.35 cm) and a thickness of 0.02 inches (0.508 mm). The passageway is present on all four sides of the housing and takes up substantially all, i.e., at least eighty-five percent, of the periphery of the housing about space 60. The extent of the passageway is interrupted only to the extent necessary to bring the electrical conductors out of the housing, as hereinafter described. Thus the passageway 73 is of maximum cross-sectional area, thereby preventing a pressure build-up within space 60 (as the result of an explosion therein). Were such a pressure build-up to occur it could result in a breaking of the housing and other undesirable consequences.

At locations on opposite sides of the housing are electrodes, generally 74, used to provide the electrical connection from the exterior to the interior of the housing. Each conductor is in the form of a rod having a main cylindrical portion 75. This represents the minimum size of the conductor and its cross-sectional area is determined by the current carrying capacity required. Extending outwardly from the main portion are four annular bosses 76–79. The principal purpose of these bosses is to lock the conductor in place between the cover and the body and thus to prevent the conductor from moving axially.

Figure 10:
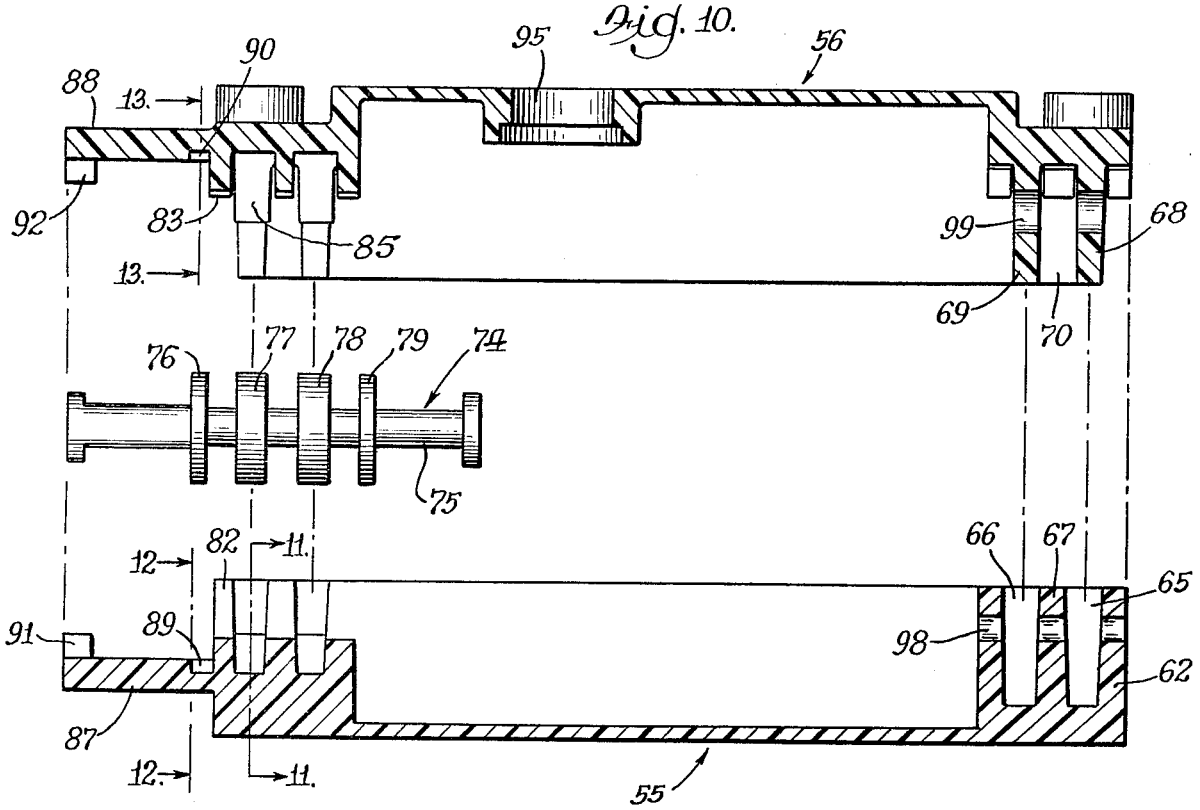
FIG. 10 is an exploded sectional view of the embodiment of FIG. 7 as seen at line 10—10 of FIG. 8.
Figure 11:
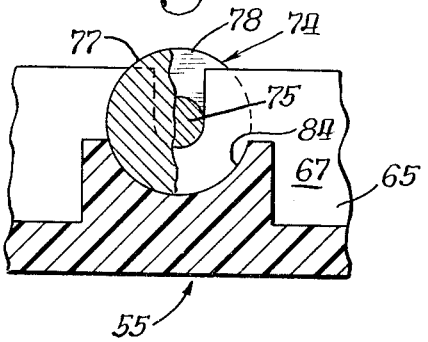
FIG. 11 is an enlarged, partial sectional view as seen at line 11—11 of FIG. 10 and also including a conductor in section.
Figure 12:
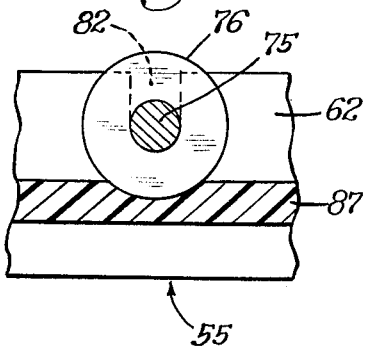
FIG. 12 is an enlarged, partial sectional view as seen at line 12—12 of FIG. 10 and also including a conductor in section.
Figure 13:
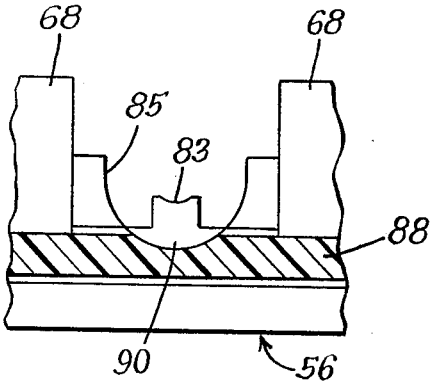
FIG. 13 is an enlarged, partial sectional view as seen at line 13—13 of FIG. 10.

Bosses 77 and 78 fit into recesses 65 and 66 respectively. As best seen in FIG. 12, the portion of the body rim 62 exterior of recess 65 has a slot 82 to receive that part of main portion 75 which exists between bosses 76 and 77. The rim about this slot forms a seat for that portion of the conductor. To fit about the top of that part of the conductor main portion, the cover has a seat 83 (FIGS. 10 and 13). Within recess 65 the body has a seat 84 which fits about boss 77 (FIG. 11). The cover also has a seat 85 which fits about the remaining part of boss 77 (FIG. 13). Similarly, there are corresponding seats which fit about the central part of the main portion 75 (i.e., between bosses 77 and 78), about boss 78, and about that part of the conductor main portion that is between bosses 78 and 79.

At each electrode location the body has a shelf 87 and the cover has a shelf 88. These form protective shields and insulators for the exterior portion of the conductor. These shelves have recesses 89 and 90 to receive a portion of the periphery of boss 76 of the conductor. The outer end of the shelves have flanges 91 and 92 which have slots therein to receive the tee-shaped end of the conductor.

The cover has an opening 95 through which the operating shaft 96 of the circuit breaker may project when the circuit breaker is in the housing (FIG. 7). That shaft fits tightly to the cover about the opening so that there is a seal to prevent the escape of burning gases should combustion occur within space 60.

The rim 62 of the body has an opening 98 therethrough and ridges 68 and 69 also have an opening 99 therethrough. When the housing is assembled these openings are coaxial. However, opening 98 is smaller in diameter than is opening 99. After the unit has been fully assembled, a tool may be inserted through the space provided by coaxial openings 98, 99 for the purpose of adjusting the circuit breaker in the course of its calibration. After such adjustment of the circuit breaker has been completed these openings are sealed closed. This is done by filling them with a hardenable plastic material in mastic form. Since the openings 98, 99 are of different diameters that plastic material is securely locked in place after it hardens.

I claim:

1. In an apparatus for use in an area in which the ambient air may comprise an explosive atmosphere, said apparatus comprising a housing defining a space and arcing-prone means such as a circuit breaker or the like mounted in said space, said means including metal components carrying electrical current, the improvement comprising:

said housing being formed of plastic and including a fixed body part and a cover part affixed to said body part, each of said parts having a portion in immediate juxtaposition to the other part, said portions defining a circuitous passageway between said space and the outside of the housing, said passageway extending about substantially all the periphery of said parts at said portions and sufficiently wide between said portions to provide a total passageway area to avoid substantial pressure buildup within the housing as a consequence of said atmosphere being ignited within said space, said passageway having an axial length between said space and the outside of the housing of at least 2.54 cm and being sufficiently narrow between said portions to cool any flame propagating from said space toward the exterior of the housing through said passageway, said metal components being directly mounted to said housing.

2. In an apparatus as set forth in claim 1, wherein the body part has a substantial depth in relation to the depth of the cover part, the majority of the depth of said space being defined by the body part, and said body part has a wall surrounding said space with a recess in said wall and surrounding said space, said cover part including a projection extending into said recess, said passageway being between said projection and the part of said wall defining said recess.

3. In an apparatus as set forth in claim 2, including rotatable shaft means extending through said cover part with an interior end in said space and an exterior end, an operating handle secured to said exterior end, and cam means secured to said interior end, said cam means being positioned for actuating said arcing-prone means when said shaft means is rotated.

4. In an apparatus as set forth in claim 1, wherein said metal components comprise two rods, each rod having a main portion of a given cross-sectional size and a plurality of spaced bosses intermediate its ends, integral therewith and defining a gap between adjacent bosses, each boss completely surrounding and extending outwardly from the main portion, said rods extending from said space to the exterior of said housing and between said parts at said portions at separate, respective locations at said periphery; and said parts each having seat means at said locations, fitting about the bosses and extending into said gap to a position in juxtaposition to said main portion at said gap.

5. In an apparatus as set forth in claim 1, wherein said plastic is a glass filled polyester resin.

6. In an apparatus for use in an area in which the ambient air may comprise an explosive atmosphere, said apparatus comprising a housing defining a space, arcing-prone means such as a circuit breaker or the like mounted in said space and two electrical conductors extending from said space to the exterior of said housing, said housing comprising a body part and a cover part, each part having an annular face in juxtaposition to the corresponding face of the other part and means to hold said cover part onto said body part, each said annular face having a plurality of sides, the improvement comprising:

said conductors being positioned at separate, respective locations and between the two parts, each conductor being in the form of a rod having a main portion of a given cross-sectional size and a plurality of spaced bosses intermediate its ends, integral therewith and defining a gap between adjacent bosses, each boss completely surrounding and extending outwardly from the main portion; and said parts being formed of plastic, said parts each having seat means at said locations, fitting about the rod and extending into said gap to a position in juxtaposition to said main portion at said gap, said parts including means at said faces and forming a vent passageway between said space and the exterior of said housing, which passageway is sufficiently narrow, as measured between said faces, and sufficiently long, as measured from said space to the exterior of the housing to cool any flame in the interior of the housing before said flame propagates to the exterior of the housing, the last mentioned means occupying at least part of each of said plurality of sides of said annular faces.

7. A housing for use in an area in which the ambient air may comprise an explosive atmosphere and defining an internal space for holding electrical wiring components between which an arc may occur which arc could ignite said atmosphere within said housing, said housing comprising:

said housing being formed of plastic and including a fixed body part and a cover part affixed to said body part, each of said parts having a portion in immediate juxtaposition to the other part, said portions defining a circuitous passageway between said space and the outside of the housing, said passageway extending about substantially all the periphery of said parts at said portions and sufficiently wide between said portions to provide a total passageway area to avoid substantial pressure buildup within the housing as a consequence of said atmosphere being ignited within said space, said passageway having an axial length between said space and the outside of the housing of at least 2.54 cm and being sufficiently narrow between said portions to cool any flame propagating from said space toward the exterior of the housing through said passageway.

8. A housing as set forth in claim 7, wherein said plastic is a glass filled polyester resin.

* * * * *